United States Patent [19]

Vitols

[11] Patent Number: 4,923,050

[45] Date of Patent: May 8, 1990

[54] LADDER SUPPORT

[76] Inventor: John R. Vitols, 300 Oxford Avenue, Brockville, Ontario, Canada, K6V 3E2

[21] Appl. No.: 394,962

[22] Filed: Aug. 17, 1989

[51] Int. Cl.[5] ..... E06C 5/04

[52] U.S. Cl. ..... 182/127; 182/17; 182/68

[58] Field of Search ..... 182/127, 68, 64, 63, 182/97, 98, 17

[56] References Cited

U.S. PATENT DOCUMENTS

| | | | |
|---|---|---|---|
| 150,053 | 4/1874 | Johnson | 182/127 |
| 242,114 | 5/1881 | Crafts | 182/68 |
| 2,586,531 | 2/1952 | Gordon | 182/127 |
| 2,964,122 | 12/1960 | Funk | 182/68 |
| 3,327,810 | 6/1967 | Johnson | 182/127 |
| 3,515,243 | 6/1970 | Ellen | 182/68 |

*Primary Examiner*—Reinaldo P. Machado

*Attorney, Agent, or Firm*—Fleit, Jacobson, Cohn, Price, Holman & Stern

[57] ABSTRACT

A machine for the disposition of a ladder includes a frame having front leg means at the proximal end thereof, rear leg means and ladder fixing means at the distal end thereof and cradle fixing means between said proximal end thereof and said distal end thereof. A cradle is also included having means for rotatable attachment to opposite sides of said proximal end of said frame. Longitudinal cradling means are disposed between said means for rotatable attachment of said cradle and the distal end of said cradle and have means for rotatable attachment of a ladder therebetween near said distal end of said cradle.

21 Claims, 4 Drawing Sheets

LADDER SUPPORT

BACKGROUND OF THE INVENTION

1. Field Of The Invention

The present invention relates to devices for the disposition of ladders and more specifically to a device for the transportation, raising and lowering of a ladder.

2. Description Of Related Art

Prior art devices for the disposition of ladders generally provide either for the upright mounting of a ladder on a trolley or for supporting a ladder in a horizontal position for transport, with means provided for deploying a ladder into a vertically upright position, and thereafter supporting the ladder by various systems employing struts, braces and similar mechanisms. Although some prior art devices for the disposition of ladders provide for the pivoting of ladders once about a single fulcrum on a support frame, such devices commonly either employ a winch to effect that pivoting or necessitate that the support frame have a high profile to provide adequate support to the lower end of the ladder.

SUMMARY OF THE INVENTION

The above-described disadvantages of prior art for the disposition of ladders may be reduced by providing a device for the two stage rotational disposition of ladders about two separate fulcrums.

Accordingly, the present invention provides a machine for supporting a ladder. The machine comprises a frame having front leg means at the proximal end thereof, rear leg means and ladder fixing means at the distal end thereof and cradle fixing means between the proximal end thereof and distal end thereof. A cradle is also included having means for rotatable attachment to opposite sides of said proximal end of said frame. Longitudinal cradling means are disposed between said means for rotatable attachment of said cradle and the distal end of said cradle and have means for rotatable attachment of a ladder therebetween near said distal end of said cradle.

BRIEF DESCRIPTION OF THE DRAWINGS

In drawings which illustrate embodiments of the invention.

DESCRIPTION OF THE PREFERRED EMBODIMENTS

Figure 1:
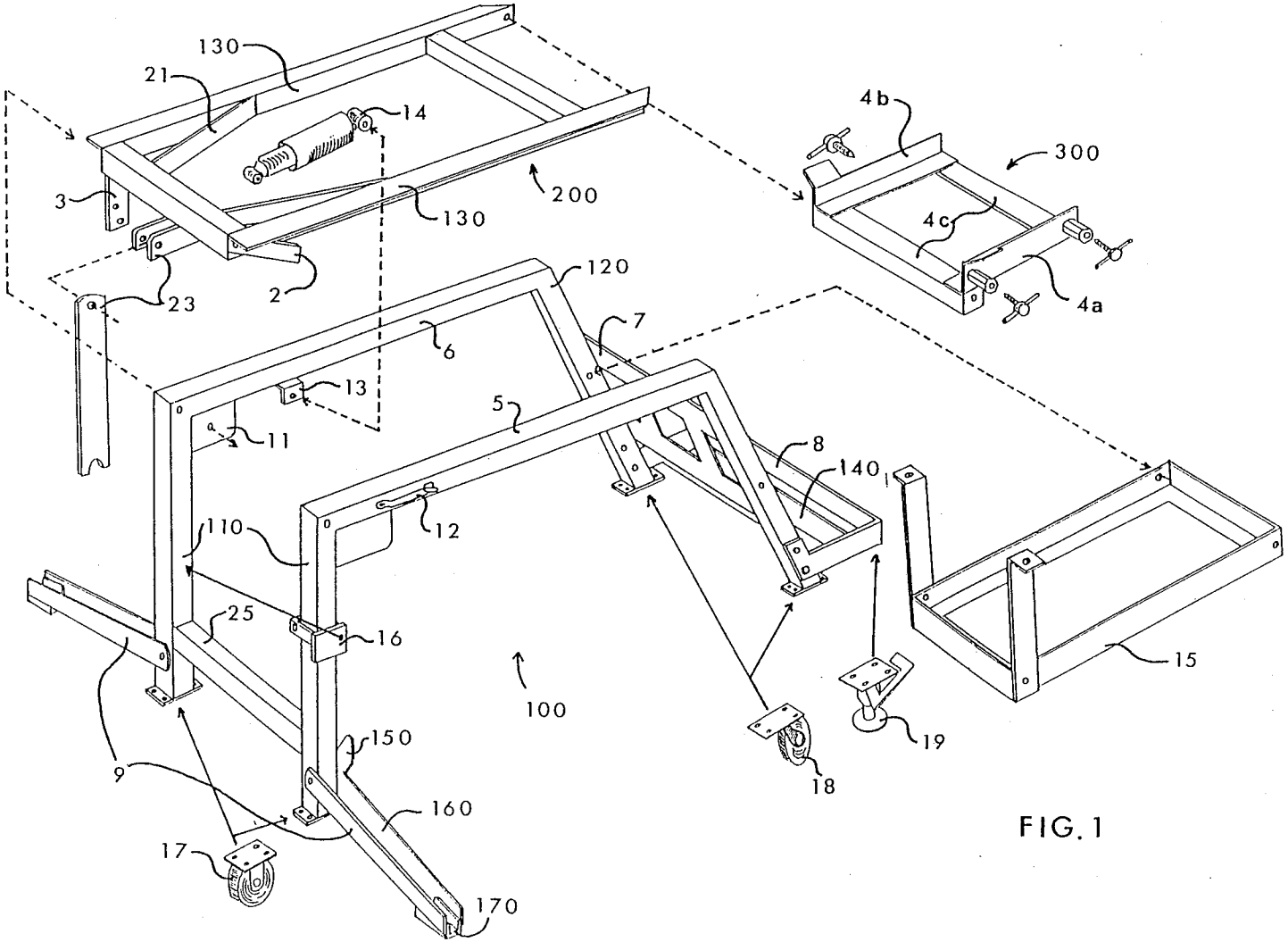
FIG. 1 is an exploded perspective view of one embodiment of the machine of the present invention.
Figure 2:
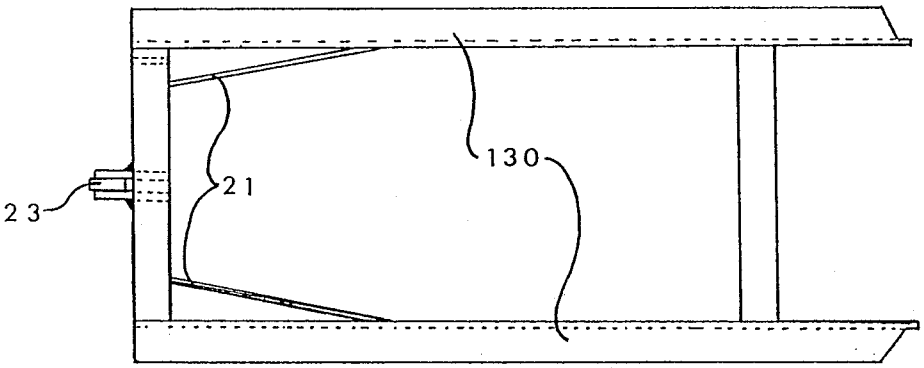
FIGS. 2 through 4 are, respectively, detailed top, side and end views of the cradle shown in the embodiment of the invention depicted in FIG. 1.
Figure 3:
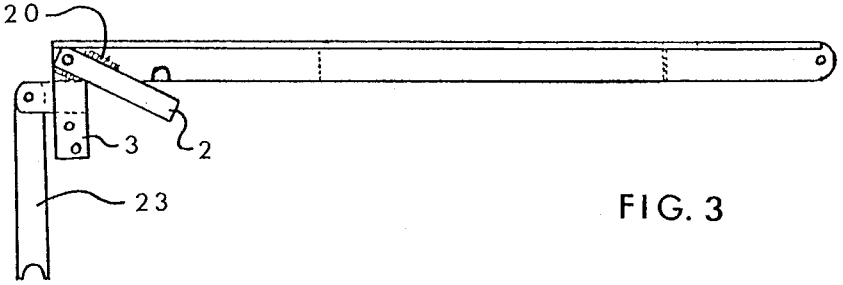
Figure 4:
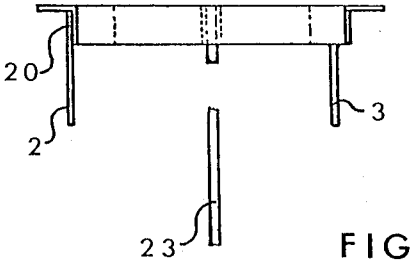
Figure 8:
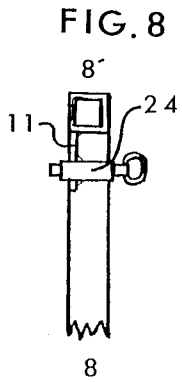
FIG. 8 is a detailed cross-sectional view of the embodiment shown in FIG. 7, taken about the line A—A′.
Figure 7:
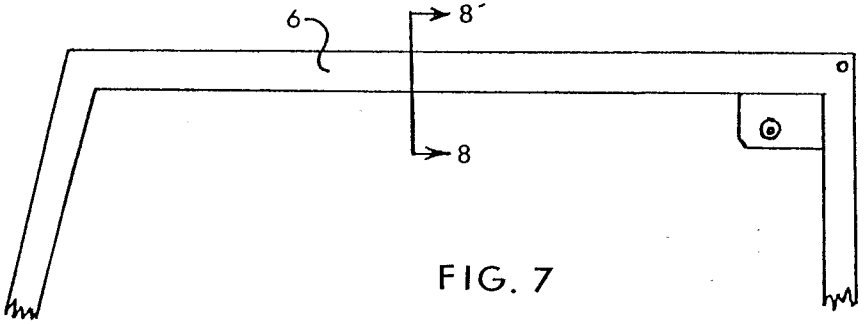
FIG. 7 is a detailed side view the upper portion of the opposite side of the frame shown in FIG. 5.

Referring to FIG. 1, longitudinal support means 5 and 6 of frame 100 may join front leg means 110 to rear leg means 120. Frame 100 may further include transverse support means 7 and 25 between opposite sides of frame 100. The rotatable attachment of cradle 200 to frame 100 may be near the top of the proximal end of the frame 100.

Ladder fixing means 8 at the distal end of frame 100 may comprise a C-shaped bracket between the opposite sides, for example between the rear leg means 120, and opening towards the proximal end of frame 100 and purposed to engage a ladder. Such a C-shaped bracket may, for example, include one or more locking floor pads 19 on the base thereof. In the alternative thereto, or in addition thereto, the C-shaped bracket may be purposed, for example by means of a floor piece 140 purposed to maintain the bottom of a ladder above the surface on which other parts of the frame 100 rest. In the alternative to such a C-shaped bracket the ladder fixing means 8 may comprise known latching means purposed to engage a ladder.

Either or both of front leg means 110 and rear leg means 120 may have lockable wheels, such as rigid casters 17 or swivel casters 18, at the base thereof, such wheels may, for example, be three or four in number. If the number of such wheels is three they may, for example, be arranged such that two of such three lockable wheels are at the proximal end of the base and one of three such lockable wheels is at the distal end of the base.

The frame 100 may further comprise stabilizing arms 9 capable of engaging the surface on which other parts of the frame 100 may be resting. Such stabilizing arms 9 may be rotatably attached to the frame 100 and may, for example, be capable of rotating outwardly and downwardly to engage the surface and upwardly and inwardly to engage the frame 100. Such stabilizing arms 9 may comprise a fin 150, projecting from the proximal end of a central member 160, and a foot pad 170 at the distal end of the central member 160.

The frame 100 may further comprise locking means 16 capable of releasably engaging such stabilizing arms 9 proximally to the fin 150 and the proximal end of the central member 160. Each such locking means 16 may, for example, comprise a plate rotatably engaging the outer surface of front leg means 110 and adjustable in height therealong by means of for example, a thumbscrew together with a clasp encircling the corresponding front leg means 110 and attached to such a plate.

The cradle 200 may include support brackets 21 between longitudinal cradling means 130 and the proximal end of the cradle 200, which may also include means for raising a ladder to provide sufficient clearance from the surface on which other parts of the frame 100 are resting, so that upon a ladder being rotatably attached to the distal end of the cradle 200 and the cradle 200 being rotated, contact of an end of that ladder with the surface on which the frame 100 is resting does not impede the cradle fixing means from engaging. Such means for raising the ladder to provide sufficient clearance may, for example, comprise a lever 23 rotatably attached to the proximal end of the cradle 200 and purposed to engage a ladder rung.

The cradle 200 may further comprise means for slowly lowering the cradle 200. Such means may comprise a shock absorber 14 and means, such as for example, a bracket 13 near the top of the proximal end of the frame 100 and a slat 3 extending downwardly from the proximal end of the cradle 200, the slat 3 having therethrough a hole for the insertion of a pin (not shown) through the slat 3 and through the shock absorber 14.

The cradle fixing means may comprise a latch/lever 12, a latch spring 2, a lever/safety pin 3, a safety pin plate 11 and latch spring positioning blocks 20. The elements of such cradle fixing means are arranged as follows. When the cradle fixing means is not engaged the latch spring 2 projects below the latch/lever 12. As the cradle 200 is raised upwardly and forwardly the latch spring 2 climbs onto and over a tapered surface of latch/lever 12. (Such tapered surface would present an upwardly and outwardly projecting surface.) The latch 12 then engages a non-tapered portion of latch/lever 12. Turning latch/lever 12 through 180° enables reversal of the orientation of the tapered surface and hence permits the latch spring 2 to climb onto and down the tapered surface and hence permits the cradle 200 (and thereby a ladder therein) to be lowered.

The means for rotatable attachment of a ladder may comprise, for example, a guide 300 having longitudinal guide means 4A and 4B and, between opposite sides of said guide 300, transverse guide means 4C, the transverse guide means 4C including means, such as for example, clamps or sets of nuts and bolts, for attaching a ladder to the guide 300. Such means 4C may also include, for example, plates attachable to guide means 4A and 4B specially adapted to engage ladders of various cross-sections.

Figure 5:
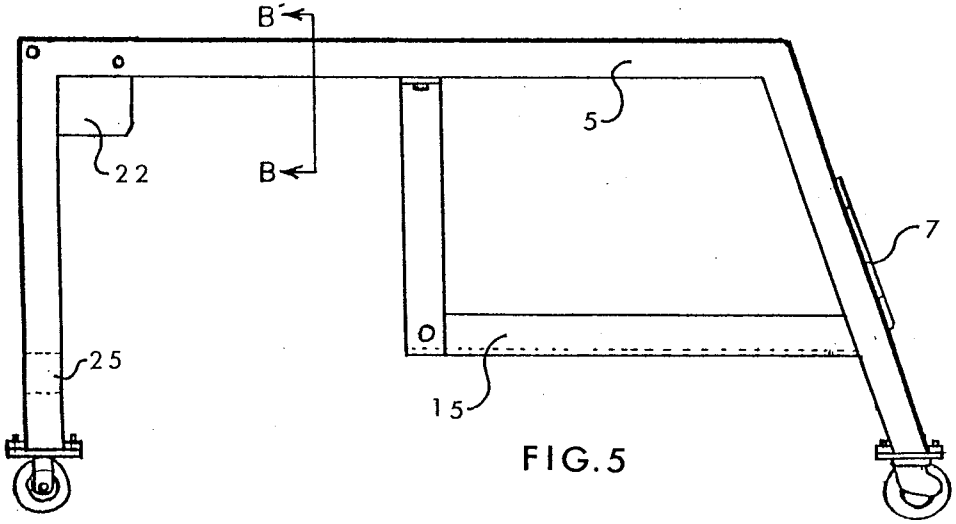
FIG. 5 is a side view of an embodiment of the frame of the present invention.
Figure 6:
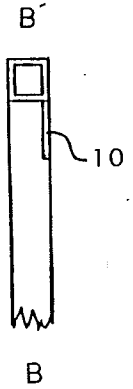
FIG. 6 is a detailed cross-sectional view taken along the line B—B′ in FIG. 5.
Figure 9:
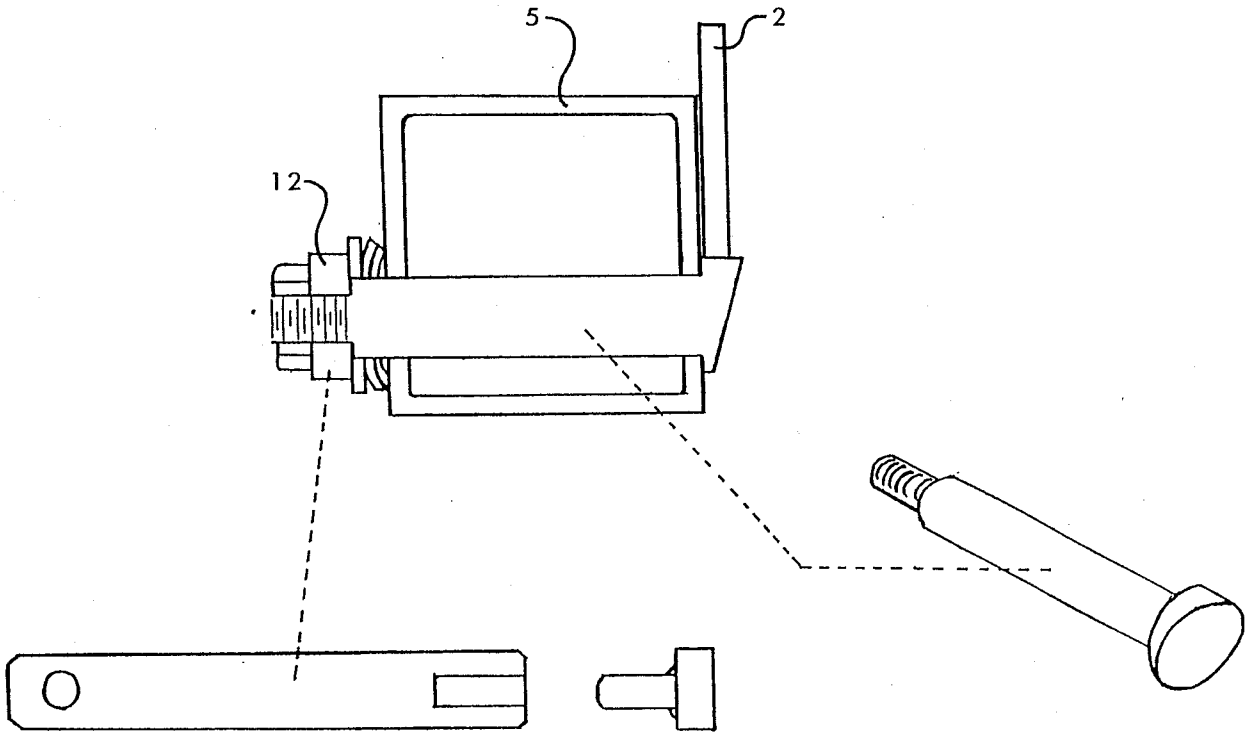
FIG. 9 is a detailed cross-sectional view of a latching mechanism present in an embodiment of the invention.

The frame 100 may further comprise storage means 15 attached, for example, to the underside of longitudinal support means 5 and 6 and to rear leg means 120 as shown in FIG. 5.

In use, an ordinary or extendable ladder may be releasably attached to the cradle 200 or guide 300. If the ladder is attached directly to the cradle 200 such attachment may be by means of clamps or of sets of nuts and bolts that permit rotation of the ladder about the distal end of the cradle 200. In the alternative, the ladder may be attached to the guide 300 by means of, for example, clamps or sets of nuts and bolts, the guide 300 having been rotatably mounted near the distal end of the cradle 200. With its longitudinal axis substantially parallel to and slightly above the upper surfaces of the cradle, the ladder may be placed in the guide with the upper and lower ends of the ladder extending past the proximal and distal ends of the cradle 200 and frame 100. The proximal end of the ladder may then be pushed downward until the cradle fixing means engages. The distal end of the ladder may then be pushed downward until the distal end of the ladder is engaged by ladder fixing means 8. After the cradle 200 has been rotated about its rotatable attachment to the frame 100, the distal end of the ladder or, if the guide 300 is present, both the distal end of the guide 300 and the distal end of the ladder, may be rotated rearwardly and downwardly to be engaged by ladder engaging means 8. The distance between longitudinal cradling means 130 may, for example, be less than the distance between longitudinal support means 5 and 6.

It will be obvious to those skilled in the art that the scope of the present invention is not restricted to the embodiments disclosed above, but may instead be varied within the scope of the following claims without departing from the spirit and scope of the invention. For example, the embodiments described above may be operated wholly or partly by hydraulics or may be adapted to outdoor use by being equipped with larger wheels and/or a larger wheelbase than would be used for indoor use. It will also now be obvious that the above-described embodiments may be enlarged and/or strengthened to enable them to be used to erect a free standing surface such as a ladder or a platform.

I claim:

1. A machine for supporting a ladder above a surface, said machine comprising:

a frame having front leg means at the proximal end thereof, rear leg means and ladder fixing means at the distal end thereof and cradle fixing means between said proximal end thereof and said distal end thereof and a cradle having means for rotatable attachment thereof to opposite sides of said proximal end of said frame, and longitudinal cradling means between said means for rotatable attachment of said cradle and the distal end of said cradle, said longitudinal cradling means having means for rotatable attachment of a ladder therebetween near the distal end of said cradle.

2. A machine as claimed in claim 1, wherein said frame further comprises longitudinal support means connecting said front leg means with said rear leg means.

3. A machine as claimed in claim 1, wherein said frame further comprises transverse support means between said opposite sides of said frame.

4. A machine as claimed in claim 1, wherein said rotatable attachment of said cradle is near the top of said proximal end of said frame.

5. A machine as claimed in claim 1, wherein said cradle fixing means comprises a latch/lever and a latch spring such that when said cradle fixing means is not engaged said latch spring projects below said latch/lever, and such that said latch spring is purposed to climb onto and over an upwardly and outwardly projecting tapered surface of said latch/lever, when said cradle is raised upwardly and forwardly, and to then releasably engage a non-tapered portion of said latch/lever, such engagement being releasable by means of said latch/lever being purposed to allow reversal of the orientation of said tapered surface and hence to allow the latch spring to climb onto and down said tapered surface.

6. A machine as claimed in claim 1, wherein said ladder fixing means comprises a C-shaped bracket between said opposite sides of said frame and opening towards said proximal end of said frame and purposed to engage a ladder.

7. A machine as claimed in claim 1, wherein said ladder fixing means comprises a latch means purposed to engage a ladder.

8. A machine as claimed in claim 6, wherein said C-shaped bracket is further purposed to maintain the bottom of said ladder above said surface.

9. A machine as claimed in claim 1, wherein said means for rotatable attachment of a ladder comprises a guide having longitudinal guide means and, between opposite sides of said guide, transverse guide means, said transverse guide means including means for attaching a ladder to said guide.

10. A machine as claimed in claim 1, wherein said frame further comprises a plurality of lockable wheels at the base thereof.

11. A machine as claimed in claim 10, wherein the number of wheels in said plurality of lockable wheels is 3.

12. A machine as claimed in claim 11, wherein two of said three lockable wheels are at the proximal end of said base and one of said three lockable wheels is at the distal end of said base.

13. A machine as claimed in claim 1, wherein said frame further comprises stabilizing arms capable of engaging said surface.

14. A machine as claimed in claim 13, wherein said stabilizing arms are rotatably attached to said frame.

15. A machine as claimed in claim 14, wherein said stabilizing arms are capable of rotating outwardly and downwardly to engage said surface and upwardly and inwardly to engage said frame.

16. A machine as claimed in claim 15, wherein said stabilizing arms comprise a fin, projecting from the proximal end of a central member, and a foot pad at the distal end of said central member, said frame further comprising locking means capable of releasably engaging such stabilizing arms proximally to said fin and said proximal end of said central member.

17. A machine as claimed in claim 1, further comprising means for raising said ladder to provide sufficient clearance from said surface so that upon a ladder being rotatably attached near the distal end of said cradle and said cradle being rotated, contact of an end of said ladder with said surfaces does not impede said cradle fixing means from engaging.

18. A machine as claimed in claim 1, further comprising means for slowly lowering said cradle.

19. A machine as claimed in claim 18, wherein said means for slowly lowering said cradle comprises a shock absorber and means for attaching said shock absorber to said frame and to said cradle.

20. A machine as claimed in claim 19, wherein said means for attaching said shock absorber to said frame and to said cradle comprises a bracket near the top of the proximal end of said frame and a slat extending downwardly from the proximal end of said cradle.

21. A machine as claimed in claim 20, wherein said slat includes means for inserting a pin through said slat and through said shock absorber.

* * * * *